United States Patent [19]

Seegmiller

[11] Patent Number: 5,015,125

[45] Date of Patent: May 14, 1991

[54] YIELDABLE MINE POST

[76] Inventor: Ben L. Seegmiller, 143 S. 400 East, Salt Lake City, Utah 84111

[21] Appl. No.: 503,654

[22] Filed: Apr. 5, 1990

[51] Int. Cl.[5] ..... E21D 15/22

[52] U.S. Cl. ..... 405/288; 248/354.1

[58] Field of Search ..... 405/150, 272, 282, 288, 405/290; 188/371; 248/354.1; 403/374, 409.1

[56] References Cited

U.S. PATENT DOCUMENTS

| | | | |
|---|---|---|---|
| 1,006,163 | 10/1911 | Winz | 405/288 X |
| 3,538,785 | 11/1970 | Grancon | 188/371 X |
| 3,877,319 | 4/1975 | Cooper | 188/371 X |
| 3,994,467 | 11/1976 | Pike | 248/354.1 X |
| 4,006,647 | 2/1977 | Oonuma et al. | 188/371 X |
| 4,100,749 | 7/1978 | Radner et al. | 403/374 X |
| 4,344,719 | 8/1982 | Thom | 403/374 X |
| 4,382,721 | 5/1983 | King | 405/288 |

FOREIGN PATENT DOCUMENTS

| | | | |
|---|---|---|---|
| 2904741 | 8/1980 | Fed. Rep. of Germany | 405/290 |
| 2045312 | 10/1980 | United Kingdom | 405/290 |

*Primary Examiner*—David H. Corbin

*Attorney, Agent, or Firm*—Ralph M. Shaffer

[57] ABSTRACT

A yieldable mine post, made of metal and in telescoping form. The post comprises a pair of mutually telescoping metal post lengths, one being slotted to receive selectively a chosen wedge for forced insertion within the slot to spread apart one of the post lengths, as to its diameter, whereby to increase surface friction between the post lengths and, thereby, the frictional resistance offered to progressive incremental displacements of one post length relative to the other in response to the downward movement of a mine roof supported by such post and further to cause resistance to sliding by forcing the outer post length to deform elastically outward and the inner post length to deform elastically inward, thus generating a "friction bubble" of "friction envelope" which progressively moves down the zone of pipe overlap.

18 Claims, 2 Drawing Sheets

YIELDABLE MINE POST

FIELD OF INVENTION

The present invention relates to mine roof supports and, more particularly, provides a telescoping yieldable mine post for facilitating both mine roof support and roof strata control.

BACKGROUND AND BRIEF DESCRIPTION OF PRIOR ART

The present invention is related to roof control in underground mines such as coal mines, trona mines, and the like.

In the case of longwall mining, merely by way of example, some type of roof support is required at the headgate, tailgate, and other areas. Currently there are extant the following techniques and materials useful for disposition between and support of a mine roof over a floor area: rigid systems, such as the installation of vertical BIG JOHNS or timber posts, which do offer slight yield but which characteristically will break under substantial roof loading; cribbing, whereby pairs of timber lengths are stacked in quadrature, one pair on top of another, between floor and ceiling; DOUGHNUT CRIBBING, constituted by a series of vertically stacked, precision cast, reenforced concrete "doughnut" elements; disc cribbing, comprising vertically stacked concrete discs, and so forth. Cribbing, i.e. or support installations, are used in underground mines at track turnout areas, track entry intersections, tailgate entries, at headgates proximate conveyor installations, and so forth.

It is common knowledge that conventional cribbing is quite expensive and makes transportation, ventilation, and production quite difficult under certain operating conditions. Timber posts such as BIG JOHNS reach peak strength very rapidly but have little or no yield, causing roof and/or floor failures and then, themselves fail under excessive loading.

Longwall mining is very much an automated and integrated continuous mining method; problems which occur as to any part of the mining system can cause stoppage of the whole operation. Should ground control problems arise anywhere, and even though the same be localized, it can have a considerable impact on the whole production process.

The Use of Mine Timbers as Support Posts: While the tensile strength of wood parallel to its grain is extremely high, the crushing strength of a wood support post is, on average, only about fifty percent of its tensile strength along the grain. Such a reduction of strength may be explained by the nature of wood. Additionally, crushed strength is drastically reduced in the presence of appreciable wood moisture.

Finally, and depending upon the character of the wood selected, a wood post will yield only a small percentage figure before the crush point is reached. Failure as to buckling strength likewise comes into play for timber, especially where the ratio of timber length to its diameter is less than eleven. Finally, duration of stresses, i.e. fatigue, is progressive in its effect upon wood timber. Where wood posts are replaced by steel posts which are unitary, then the desired ability to yield progressively is drastically reduced.

Again, as to longwall mining, controlled roof caving is extremely important and some yield as to support posts is needed for roof control during the caving process.

Roof control is likewise necessary to deter failures of underground coal pillars and entries as may be caused by combined effects of induced stresses in surrounding rock and coal and the inability of rocks and coal, of themselves accommodate appropriately.

A skilled engineer, being aware of the nature of the mine and its surrounding formations, will be able to calculate the degree of yield in posts in particular locations that will be required to maintain roof control under a variety of conditions. Such design and accommodation of roof supports, as is made possible in the present invention, can accommodate any one of a host of differing in situ conditions. No art, patent or otherwise, is known which relates to the use of telescoping posts, fabricated from steel as herein set forth and claimed, whereby progressive frictional forces and elastic/plastic deformations allow for and yet delimit post yield in response to roof pressures. The reader, however, should be aware of certain teachings in the following technical publications: (1) COAL VOICE, Jan./Feb. 1990 edition, page 27, article entitled TECH TRANSFER, Artificial Supports increase Safety in Underground Mines, and (2) RI 9279 REPORT OF INVESTIGATIONS/1989, YIELDING STEEL POSTS, by J. P. Donford and L. N. Henton, BUREAU OF MINES, U.S. DEPT. OF INTERIOR. In the first publication two concepts are taught: (1) a yielding steel post with top and bottom legs, the bottom leg having an outer expansion ring and the top leg having a flared lower end which is inserted over the ring, the oversized ring expanding the top leg, the latter yielding radially, during roof-floor convergence. It is noted that, in contrast with the present invention, no provision is made for collapsing the post structure for transit, nor for utilizing wall-friction forces beyond the expansion ring; further, failure such as splitting of the top leg, through excessive radial yield beyond its elastic limit, is likely to occur through plastic deformation to point of rupture. As to the second concept, an expensive, hydraulically actuated yielding post is provided, the same utilizing a pressure lease valve. In the second (2) publication, the mathematics of flow of material through a conical die are developed and importantly, as to concept (1), a chancing of splitting the outer leg in concept (1), supra, is set forth, and the requisite lowering of the steel schedule from schedule 80 to schedule 40, relative to the upper, radially yieldable leg, necessarily reduces the strength of the over-all post structure, constraints not present in the present invention.

BRIEF DESCRIPTION OF PRESENT INVENTION

According to the present invention a pair of post lengths, generally comprising respective steel tubes, are telescopically related, each being provided with an end bearing member, such as a bearing plate, and preferably an anchor protrusion respectively thereat. The innermost post length of the telescopic combination includes a longitudinal wall slot, designed for the reception of at least one wedge that can be employed to enlarge the diameter of a respective tubular post length at a desired location. The enlargement produced, relative to the transverse cross-section of the slotted tubular post, serves as a pressure bubble or pressure envelope to progressively increase frictional forces between the inside wall of the outer post length and the outer wall surface of the slotted post length. More important than increase in sliding friction, the interference fit produces an expansion and also a compression, respectively, as to the bore of the outer post length and the girth of the inner post length, at their common juncture, which operate preferably within the elastic limits of their materials and certainly within their elastic/plastic deformation ranges, below point of failure. Indeed, and by judicious selection of the material of the wedge, its dimensions and so on, and also its placement in the slot, there may be provided a yield feature for the over-all mine post construction, which yield feature is progressive and yet progressively delimited until a maximum stress point is achieved without essential further inward telescoping of one tubular length relative to the other. In addition to the operation of the aforementioned pressure envelope, the wall friction between the telescoping post lengths can be employed to control axial yield during roof-floor convergence.

For ease of assembly and transport, the slotted tubular section comprising one post length may be tack welded after radial compression, this to ease the wall frictional forces between the tubular lengths such that the two post lengths may be telescoped in a direction together toward the respective ends thereof, thereby reducing the over-all length of the mine post and allowing for ease of transport. In connection with such ease, handles may be provided the bearing plates at the opposite ends of the post lengths. Also, anchor protrusions may be provided the bearing members.

Finally, a stabilizing plate can be provided for accommodating uniform loading of the slotted post length, thereby tending to preclude buckling of the latter.

The term "elastic/plastic" as used herein refers to the fact that the innermost and outermost tubular post lengths, in their mutual interaction, operate on the stress-strain curve preferably in the elastic region below the yield point but certainly within the elastic-plastic region before the point of rupture. Thus, the engagement of the enlarged girth of the innermost tubular post length 17 with the inner wall surface of the outermost tubular post length 13 produces an expansion of the bore of the latter and a diminution of the circumference of the former, in forming a common equidimensional friction juncture, where both expansion and diminution are preferably within the materials' elastic limits but certainly within their respective elastic/plastic ranges.

OBJECTS

Accordingly, a principal object of the present invention is to provide a new and improved yieldable mine post.

A further object is to provide a telescoping metal mine post, provided with facility for increasing and also varying the frictional and other resistance forces generated by tendencies of the telescoping post lengths thereof to come together.

A further object is to provide a versatile telescoping mine post comprised of a pair of telescoping post lengths, the feature of a wall slot and wedge being utilized in the design of one of the post lengths, whereby the mine post support in its over-all design can be used to support a mine roof and yet yield in a controlled manner under the pressures of the mine roof, the character of the yield being progressively controlled so as to permit the post to have a desired load-bearing capacity curve for progressive roof-floor convergence.

An additional object is to provide a mine post that can be suitably anchored in place in vertical condition in a mine opening.

An additional object is to provide in a mine post a stabilizing plate for providing, as much as possible, uniform force distribution about the end of one of the post lengths utilized, this to avoid tendencies of buckling.

A further object of the invention is to provide a telescoping yieldable mine post designed to accommodate and facilitate roof strata control by permitting selective yield at post installation areas as desired.

BRIEF DESCRIPTION OF THE DRAWINGS

The present invention, together with further objects and advantages thereof, may best be understood by reference to the following description, taken in conjunction with the following drawings in which:

In FIG. 1 yieldable mine post 10 is shown to include a post section 11 and also, fitted telescopingly therein, a post section 12. Post section 11 includes a post length 13 which is hollow and which has, welded thereto at its base, a bearing member such as bearing plate 14. Lower circumferential weld W' is indicated; other typical welds are indicated by the letter W. Bearing plate 14 has a depending anchor protuberance 16, which may be designed in the form of the tip of a sharpened pencil, by way of example. The upper post section 12 includes a post length 17 of some radial resiliency and having wall slot 18. In initial fabrication, the portions 19 and 20 of the post length 17 are urged somewhat together so as to reduce the frictional effect between the outer surface of post length 17 and the inner surface of post length 13, this so that the respective post lengths may be telescoped together, at least moderately, for ease of transport and initial placement in vertical disposition within a mine opening. The consequent reduction in diameter may be secured by tack welds at 21, 22, and 23; if so included, tack welds 23 are desirably permanent, but tack welds 21 and 22 can be broken by a hammer upon initial post placement. The squeezing, diametrically, of the post length 17 can be further aided by the fact that the upper portion at 19 can be welded only partially about the periphery of the circular upper edge of the post length 17 relative to upper bearing plate 24. This is clearly seen in FIG. 4; kindly reference the weld 25 relative to the bearing plate 24. A completely circular weld at 25, however, can also be used. The upper bearing member 24, i.e. a plate, a channel for receiving an I-beam roof support, or a member of any other desired configuration, likewise can include a central, outwardly oriented anchor protrusion at 25' which may be similar in configuration to anchor protrusion 16 in FIG. 1.

Figure 1:
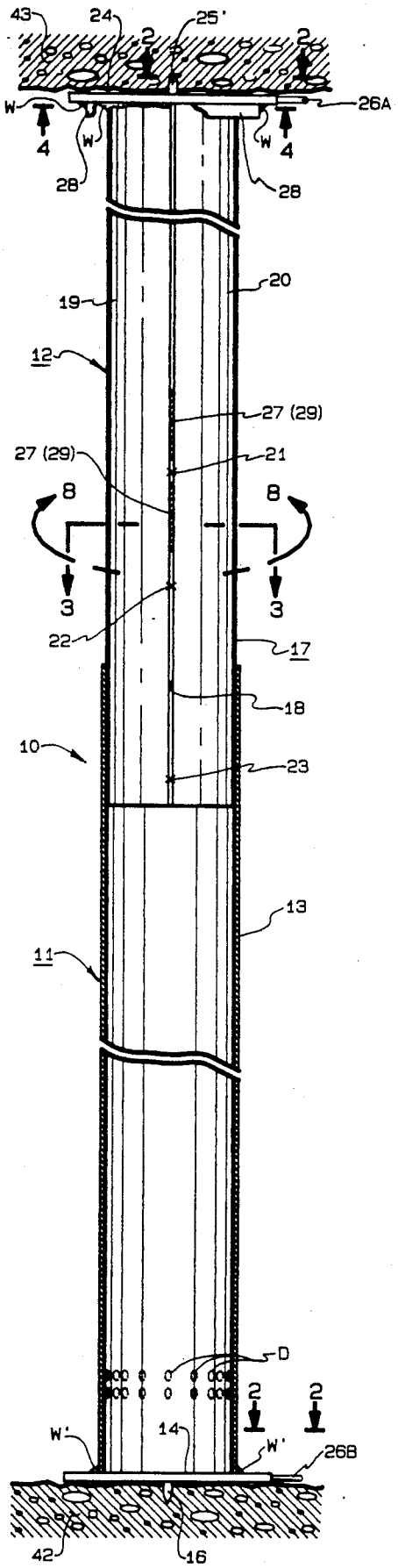
FIG. 1 is a side elevation, partially in section and broken away, of a yieldable mine post constructed in accordance with the principles of the present invention in a preferred embodiment thereof.
Figure 2:
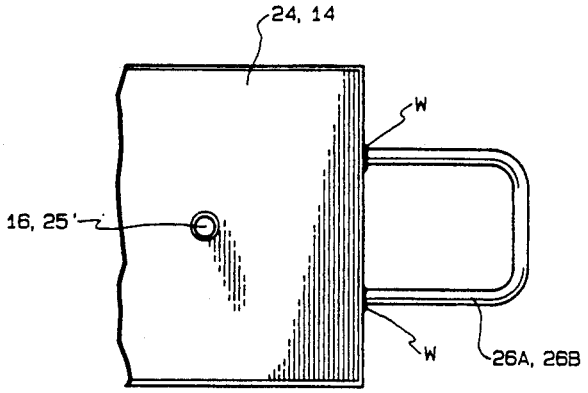
FIG. 2 is a fragmentary detail taken along the lines 2—2 in FIG. 1.

Both of the bearing plates may be conveniently provided with coplanar handles 26A and 26B as seen in FIGS. 1 and 2, this for ease of both carrying and positioning the yieldable posts. These handles 26A and 26B may be welded or otherwise secured to their respective bearing plates.

Figure 3:
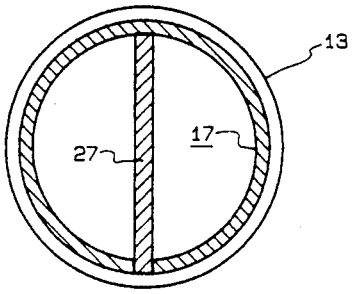
FIG. 3 is a horizontal section, looking downward, and taken along the line 3—3 in FIG. 1.

FIG. 3 illustrates a transverse cross-section of the yieldable mine post, illustrating the telescoping nature of the two post lengths as well as the positioning of a representative wedge 27.

In returning to a consideration of FIG. 1, it is seen that a stabilizing plate 28, of thicker dimension widthwise than the bearing members or plates 14 and 24 can be provided and is welded by welds W for example, to bearing plate 24 at its underside. This stabilizing plate 28 may likewise be welded to the left-hand portion, as shown, post length 17, as shown by welds W. However, there may not exist welding on the opposite side, this so as to not deter the diametrical shrinkage or reduction as produced by the initial squeezing of the post length 17.

Figure 6A:
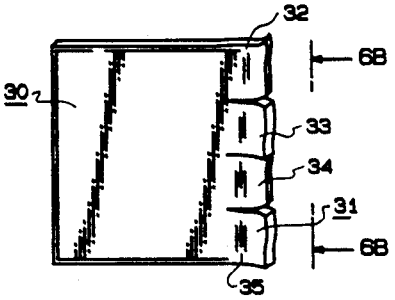
FIG. 6A illustrates in perspective view an alternate wedge pattern, having rear-most fins spread apart for ease of setting the wedge.
Figure 6B:
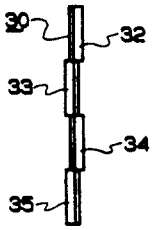
FIG. 6B is a side elevation taken along the lines 6B—6B in FIG. 6A, illustrating the rear portion of the wedge of FIG. 6A.

Wedge 27 in FIG. 3 may take one of several forms. Three such forms are illustrated in FIGS. 5, 6A–6B, and 7A–7B. Accordingly, in FIG. 5 the wedge is simply planar in form; the insert edge of this particular wedge, termed wedge 29, may be chamfered at edge 30, if desired, to provide ease of insertion within the slot 18 in FIG. 1. Indeed, all of the forward edges of the wedges may be chamfered if such is desired. FIG. 6A illustrates an alternate type of wedge, termed wedge 30, wherein the rear edge thereof at 31 is serrated by successive slots forming a series of mutally adjacent fins at 32, 33, 34, and 35. These fins are oppositely turned, slightly, as seen in FIG. 6B, this to provide for an enlarged edge, so to speak, for hammer or mallet impact.

Figure 7A:
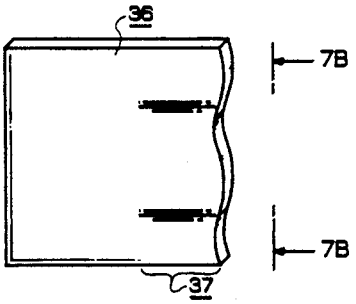
FIG. 7A is a front elevation of an alternate wedge that can be used for insertion in the composite post of the invention.
Figure 7B:
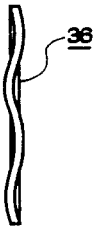
FIG. 7B is a side elevation taken along the lines 7B—7B in FIG. 7A, illustrating the wavy character of the rear portion of the wedge, aiding both in wedge placement and in the spreading function thereof.

FIG. 7A illustrates another type of wedge, termed wedge 36, at least the rear portion 37 of which may have a wavy contour as indicated in FIG. 7B. Such wavy contour not only aids hammer or mallet impact, but also further serves to spread apart progressively the opposite sections of post length 17 as the wedge is driven home in the manner shown by wedge 27 in FIG. 3.

Figure 7C:
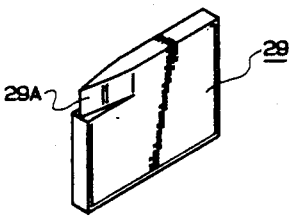
FIG. 7C is a perspective view of a preferred form of wedge.

FIG. 7C illustrates yet another and preferred form of wedge 29, having an upper leading edge portion 29A which tapers forwardly, which edge portion faces and advances into post length 13 as its carrier, post length 17, is so advanced.

Figure 8:
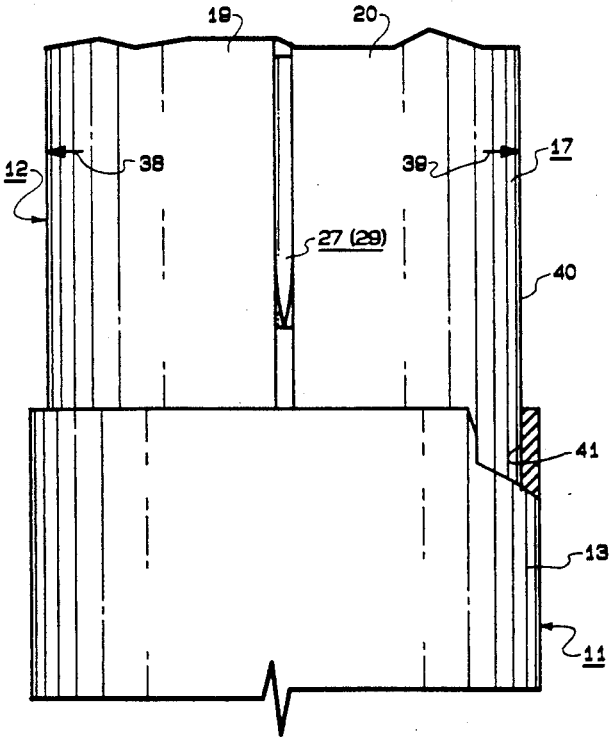
FIG. 8 is an enlarged arcuate detail, taken along the arcuate line 8—8 in FIG. 1, illustrating that by wedge placement one of the post lengths may be slightly enlarged for increasing frictional forces between the outer surface of such post length and that hollow post length within which it is positioned.

FIG. 8 illustrates the principle that when the wedge 27 is driven home as seen in FIG. 3 as well as FIG. 8, whatever that wedge from may take, the same serves to create an enlargement or slight bulge, as indicated by arrows 38, 39, whereby to spread apart slightly the diameter of post length 17 and thereby increase the frictional effect and compression dynamics between outer wall 40 of post length 17 and inner wall 41 of post length 13. Thus, a greater resistive frictional force, as contributed by surface friction but more importantly by mutual wall surface compression deformation at the "friction bubble", is created, i.e., whereby to retard the telescoping of the upper post length 17 relative to lower post length 13. This pressure bubble advances downwardly in the outer post length 13 as the roof load compresses against plate 25A of the upper post length 17.

Figure 4:
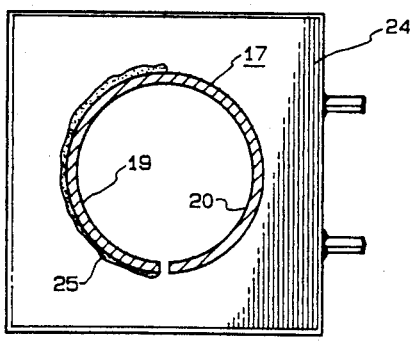
FIG. 4. is a transverse horizontal section, looking upward, taken along the line 4—4 in FIG. 1 and illustrating one type of weld pattern relative to the upper post length shown.
Figure 5:
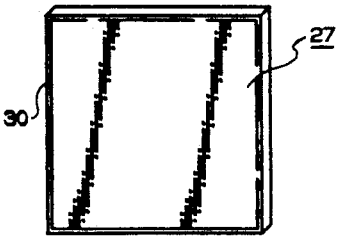
FIG. 5 is a perspective view of a representative wedge that may be used in the invention.

The operation of the invention will now be discussed. Let us assume, merely by way of example, that the height of the mine opening between line floor 42 and mine roof 43 is approximately nine (9) feet. In initial fabrication, the yieldable mine post 10 will be telescoped inwardly, relative to the post lengths 13 and 17, each e.g. six feet long, such that the over-all length of the yieldable mine post will be, say, slightly over six (6) feet. The telescoping nature of the overall construction will be made possible by the initial circular compression or squeezing, during fabrication, of the upper post length 17 by suitable tool or vise, and the tack welds possibly applied, so as to reduce the frictional effect between the outer wall of post length 17 and the inner wall of post length 13. This compressive disposition of post length 17 may be preserved by temporary tack welds supplied at 21 and 22, as well as by a more or less permanent tack welds at position 23. At this point, of course, the wedge at 27 will not have been inserted in position. It is noted that, in one instance, by virtue of the partial weld, i.e. the weld 25, only partially going about the upper periphery of post length 17, see FIG. 4, a major part of that end will be free to move inwardly, under applied compressive forces, so as to assume the reduced circumference of the compressed post length 17 as may be desired. Again, in this one example, this allows for easy slippage of the upper post length 17 relative to lower post length 13 so that the same can be easily telescoped together for purposes of portability. Again, this portability is aided by the inclusion of handles 26A and 26B relative to the upper and lower bearing plates 24 and 14.

When a desired mine location is reached, then the mine post is oriented vertically as shown and a spreader or jack mechanism, such as a SIMPLEX jack, is used to urge apart and thereby lengthen the yieldable mine post, i.e. by spreading vertically post length 17 relative to post length 13, such that the respective bearing members or plates 24 and 14 come in a thrusting contact with the exposed surfaces of mine roof 43 and mine floor 42. While the mine floor may be composed of relatively soft material, e.g. clay, and so forth, the upper surface will generally be hard and frequently uneven. Accordingly, the pressures of the SIMPLEX jack may prove sufficient, not only to properly mount the yieldable post, but also to produce some deformation proximate the edges of bearing plate 24. Indeed, the unevenness of the surface of the mine roof may be such that, in the absence of stabilizing plate 28, uneven compressive forces will be applied relative to end edge areas of post length 17, which engage the lower surface of bearing plate 24. Here the stabilizing plate 28 can come into play and, by virtue of its increased thickness, will tend to keep compressive thrusting forces at the edge of post length 17 relatively uniform, this so that stressing is essentially uniform about the entire periphery of upper post length 17. This feature tends to preclude uneven stressing of the post proximate its upper post length and a buckling, at one side or other, of such post. Wood wedges or shims can of course be installed at one or both ends of the post construction, depending upon roof-floor contours.

Once the maximum post length is achieved by operation of the SIMPLEX jack, or other mechanism used to enlarge post length and apply simultaneously compressive forces against the mine floor and roof, then wedge 27, of whatever form, is inserted and thrust home, as by hammer, mallet, or other means, such that the same assumes the position as shown by wedge 27, for example, in FIG. 3. The purpose for the inclusion of wedge 27, whatever its other forms may be as seen by wedges 27, 29, 30 and 36 in FIGS. 5, 6A–6B, 7A–7B, and 7C, will be to enlarge the slot 18 at and proximate the point of wedge insertion and hence create a circumferential enlargement by way of an enlarged diameter, whereby to spread apart the wall portions of post length 17 and hence increase the frictional effect between the outer wall of post length 17 and the inner wall of post length 13. Consider the following example: Upper post length 17 has an outside diameter of 4 inches and, therefore, a circumference of 12.566 inches (C equals pi times D). A slot 18 one-inch wide wide is formed by cutting out a one-inch wide longitudinal wall strip, and the post length is radially compressed and the slot edges tack-welded together so that, now, the outside diameter is reduced one-inch to the figure, 11.566 inches. Assume that but one wedge, i.e. preferred wedge 29, is one-half inch thick and is used for forced insertion in the slot, between tack welds, about one-inch above the top of post length 13 at a time when the upper post length 17 has been slid thirty-six inches into the lower post length 13, in a manner to reduce angular displacement of the upper post relative to the lower post and hence edge-gouging of such upper post into the inner wall surface of the lower post. The inclusion of the wedge width will increase the circumference of the inner post to 12.066 inches, resulting in a diameter for the inner post at this point of 3.841 inches. Consider, further, the nominal inside diameter of lower post length 13 to be 3.824 inches. Subtracting 3.824 from 3.841, one derives an interference, i.e. diameter difference, of 0.017 inches. Depending upon the choice of material for the relative parts, an interference from 0.010 to 0.050 inches should be satisfactory to achieve the necessary interference fit and consequent pressure bubble or pressure envelope between the two post lengths as the composite post design is placed under load.

This pressure envelope advances downwardly, and ultimately the lower edge of the upper post bottoms upon lower plate 26B of the lower post.

Figure 9:
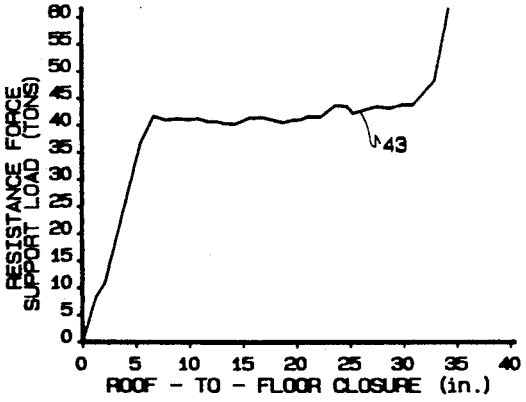
FIG. 9 is a plot of a representative curve that may be experienced in the present invention, for a selected one of differing wedges when plotting support load (in tons) of the mine post, i.e. resistance force, i.e. between sections of the mine post, and roof-to-floor closure (in inches).

The graph shown in FIG. 9, an actual graph of mean values for a series of experiments using an aluminum wedge, illustrates that at the time the composite post structure is in place, the graph starts at zero ("0"). Progressive incremental descent of the roof produces a rapid rise in inter-post frictional resistance, and hence loading of the composite post, corresponding to initial entry of the pressure envelope into the upper end of the power post length, until a load of approximately 40 tons is reached. Further incremental roof descent experiences, over a wide range of closure, a same order of loading, the curve rising somewhat because of increased general frictional forces, e.g. due to wall surface irregularities, etc., as the penetration of the upper post length into the lower post length increases. Such frictional forces can be increased by the judicious use of inwardly protruding dimples D in lower post length 13 and their frictional contact with the lower outer wall surface of post length 17. When the lower end of post length 17 bottoms against plate 26B of the lower post length 13, the loading dramatically increases with but slight further roof-to-floor closure.

One, two or more wedges can be used, as design considerations dictate. The chamfered or pointed nature of the leading edge of the wedge, e.g. wedge 29, facilitates a smooth leading edge of the enlargement producing the pressure envelope.

In practice it may very well be, in numerous instances, that the mine engineer will wish to allow for a slight decline or, indeed, a partial collapse of the mine roof in order to reduce other stresses at other mine roof areas. The present mine post 10 provides for a controlled yield, and thereby a reduction enclosure distance between the mine floor and mine roof as may be desired. It is noted that this yield is automatic and may be predetermined by choice of material of the wedge, the construction of the material of the post, wedge dimension and placement, and so forth. This yield will be progressively resisted as the upper post length 17 travels incrementally downward relative to post length 13 until, where the upper edge of post 13 approaches the wedge location, the frictional and dynamic forces between the outer wall of post length 17 and post length 13 will dramatically increase to retard dramatically and lessen the downward incremental travel of post length 17. Tack welds above the wedge, if need, see FIG. 1, as at 21 may be broken to allow the post length 17 to expand and thus increase wall-frictioned forces between the post lengths at locations above the wedge, depending upon the operational curve desired, see FIG. 9.

Consider by way of example that the subject wedge may be made from steel, copper, or aluminum. For the alloy chosen, assume that the Young's modulus of the steel selected is 30 million, that of copper is 15 million, and that of aluminum is 10 million. As one goes down the Young's modulus values, the wedge material will strain more for a given stress and hence, the effect of the pressure bubble will be to cause lesser circumferential yielding in the outside pipe than in the inside pipe when the friction bubble passes any given point. Such a change may cause different closure forces on the post to result.

Other variable factors include the particular position of the wedge, its vertical dimension, thickness, and so forth. Curve 43 in FIG. 9 would be altered where a steel wedge is employed; in the latter instance, for but a small decline in mine floor height, the resistance force between the two post lengths will dramatically increase to progressively reduce further incremental roof declines and thus dramatically increase the retentive force of the composite yieldable mine post in that present location. Correspondingly, for a softer material such as a copper or aluminum alloy, the characteristic curve could be that as shown at 43, allowing for mine roof decline and yield a somewhat larger distance before the resistance force between the post lengths 13 and 17 becomes appreciable so as to increase dramatically the over-all thrusting power of the post section relative to further tendencies of roof decline or lowering.

Accordingly, by judicious selection of wedge dimensions, placement, and material, the steel mine post may be engineered to accommodate different physical characteristics in mines and thus accommodate desired permissable yields for mine locations. This will serve to enhance opportunities for mine roof control and thereby reduce mine roof sloughing off and even failure when such is undesired. Furthermore, the tremendous pressures that might occur in the absence of post yield can possibly be avoided, thereby precluding mine post failure.

Thus, the present invention presents a telescoping yield-type structure, usable in coal mines, trona mines, and the like, whereby roof control and stabilization becomes possible, wherein mine post integrity is preserved, and permits some yield to local roof pressures whereby stress patterns in the mine roof do not get out of hand.

While particular embodiments of the present invention have been described, it will be obvious to those skilled in the art that various modifications and changes may be made without departing from the invention in its broader aspects; and therefore the aim in this invention and in the claims appended hereto is to cover all such changes and modifications as fall within the true spirit and scope of the invention.

I claim:

1. A mine post for vertical disposition between a mine roof and a mine floor and including, in combination, first and second post sections each having a respective, post length, said post lengths being mutually telescoping whereby one of said post lengths is innermost and the remaining of said post lengths is outermost, each of said post lengths having an outer end provided with a bearing member and also an inner end, each of said inner ends being mutually frictionally, telescopingly engaged, said innermost tubular post length being provided with a longitudinal wall slot, and wedge means inserted in said wall slot beyond said inner end of said outermost tubular post length for expanding the girth of said innermost tubular post length essentially within its elastic/plastic limit, at and proximate the area of wedge means insertion, for progressively increasing essentially elastic/plastic expansion of said outermost tubular post length and also increasing sliding friction resistance forces and essentially elastic/plastic coaction, between said tubular post lengths as said wedge means enters into and progresses within said outermost tubular post length, in response to post axial compression forces and yield incremental movements of said innermost tubular post length in and relative to said outermost tubular post length, whereby to allow for progressively increased loading and progressively reduced yield of said mine post in accordance with mine roof lowering, relative to the mine floor, and desired mine roof control.

2. The structure of claim 1 wherein said innermost tubular post length, prior to wedge insertion, is initially radially compressed and provided with tack welds at said wall slot, whereby to maintain temporarily said innermost tubular post length in radially compressed condition for reduction of sliding friction forces between said innermost and outermost tubular post lengths, thereby accommodating partial collapse of said post sections to shorten temporarily the over-all length of said mine post during transport and initial mine placement.

3. The structure of claim 1 wherein at least one of said bearing members is provided with an outwardly directed anchor protrusion.

4. The structure of claim 1 wherein each of said bearing members is provided with outwardly and mutually oppositely directed anchor protrusions.

5. The structure of claim 1 wherein said wedge means comprises an essentially flat, plate-like wedge.

6. The structure of claim 1 wherein said wedge means comprises a plate-like wedge having a slotted rear portion forming a series of mutually staggered strips.

7. The structure of claim 1 wherein said wedge means comprises a plate-like wedge having a series of wave undulations traverse to the direction of wedge insertion into said wall slot.

8. The structure of claim 1 wherein said wedge means comprises a plate-like wedge having a tapered leading edge portion disposed in said slot.

9. The structure of claim 1 wherein said innermost tubular post length has an inner wall, said wedge means, upon complete insertion, being dimensioned to retain its engagement with said wall slot and likewise abut that portion of said inner wall of said innermost tubular post length which is opposite said wall slot thereof.

10. The structure of claim 1 wherein each of said bearing members is provided with a handle.

11. The structure of claim 1 wherein each of said bearing members is provided with a coplanar, looped, outwardly directed handle.

12. The structure of claim 1 wherein said innermost and outermost tubular post lengths mutually radially interact, proximate the region of wedge means insertion, within their respective elastic limits.

13. The structure of claim 2 wherein said bearing members, provided said outer end of said innermost tubular post length, is welded only part-way to and about said outer end of said innermost tubular post length, whereby to permit radial flexure and transverse circumferential compression of said innermost tubular post length during mine post fabrication and preparation for transport.

14. The structure of claim 2 wherein at least one of said tack welds is essentially permanent and is located proximate the inner end of said innermost tubular post length.

15. The structure of claim 2 wherein any initial tack welds on a side of said wedge means remote from said outermost tubular post length are removed, whereby to permit said outermost tubular post length resiliently to expand and thereby increase wall-friction forces between said post lengths.

16. The structure of claim 14 wherein a stabilizing plate, in dimension thicker than said bearing plate attached to said outer end of said innermost tubular post length, is affixed to said bearing plate at that side thereof opposite its bearing surface.

17. In combination, an innermost tubular post length having a longitudinal wall slot, an outermost tubular post length slideably and telescopingly receiving and overlapping a portion of said innermost tubular post length, and wedge means inserted into said wall slot, at a region thereof directly from the lateral exterior and beyond said portion of said innermost tubular post length, and dimensioned to spread apart said wall slot and thereby incrementally increase the girth of said innermost tubular post length at and proximate the area of wedge means' insertion, whereby to selectively increase wall friction forces between said innermost and outermost tubular post lengths and also increase elastic/plastic mutually intercooperating deformation thereat in said innermost and outermost tubular post lengths, the outermost ends of each of said post lengths each being provided with a bearing plate.

18. The structure of claim 17 wherein said wedge means possesses a characteristic yield, thickness-wise, whereby to produce a progressively controlled wall-friction characteristic between said tubular post lengths in response to end loading together of said tubular post lengths.

* * * * *